US008814297B2

(12) United States Patent
Usuda et al.

(10) Patent No.: US 8,814,297 B2
(45) Date of Patent: Aug. 26, 2014

(54) PRINTING APPARATUS, PRINTING METHOD AND PRINTED MATTER

(71) Applicant: Seiko Epson Corporation, Tokyo (JP)

(72) Inventors: Hidenori Usuda, Matsumoto (JP); Takayoshi Kagata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/756,064

(22) Filed: Jan. 31, 2013

(65) Prior Publication Data

US 2013/0201231 A1 Aug. 8, 2013

(30) Foreign Application Priority Data

Feb. 2, 2012 (JP) ..... 2012-020760

(51) Int. Cl.
*B41J 9/38* (2006.01)

(52) U.S. Cl.
USPC ..... 347/9

(58) Field of Classification Search
CPC ..... B41J 2/04541
USPC ..... 347/9, 14, 15, 20, 44, 47, 98, 100, 102, 347/106, 107
See application file for complete search history.

(56) References Cited

U.S. PATENT DOCUMENTS

| | | | | |
|---|---|---|---|---|
| 7,121,660 | B2 | 10/2006 | Ide et al. | 347/101 |
| 8,118,401 | B2 | 2/2012 | Yoshida | 347/43 |
| 2011/0221807 | A1 | 9/2011 | Yoshida | 347/9 |
| 2012/0249668 | A1 * | 10/2012 | Denda et al. | 347/20 |
| 2012/0287200 | A1 * | 11/2012 | Yano et al. | 347/20 |
| 2013/0108841 | A1 * | 5/2013 | Denda et al. | 347/20 |
| 2013/0182057 | A1 * | 7/2013 | Koase | 347/102 |

FOREIGN PATENT DOCUMENTS

| | | |
|---|---|---|
| JP | 08-150800 | 6/1996 |
| JP | 10-000850 | 1/1998 |
| JP | 2004-122496 | 4/2004 |
| JP | 2004-122505 | 4/2004 |
| JP | 2010-052244 | 3/2010 |
| JP | 2011-183677 | 9/2011 |

* cited by examiner

*Primary Examiner* — Kristal Feggins
(74) *Attorney, Agent, or Firm* — DLA Piper LLP (US)

(57) ABSTRACT

Provided is a printing apparatus including a first nozzle through which to eject a clear ink, a second nozzle through which to eject a color ink, a third nozzle through which to eject a glitter ink, and a control unit that controls ejections of the inks through the first nozzle, the second nozzle and the third nozzle, wherein the control unit performs control, at the time of forming a color image on a transparent medium, in a manner that ejects the clear ink onto the transparent medium through the first nozzle, ejects the color ink to be ejected onto the clear ink through the second nozzle to form an image resulting from the color ink, and ejects the glitter ink onto the clear ink and the color ink through the third nozzle.

8 Claims, 8 Drawing Sheets

1

PRINTING APPARATUS, PRINTING METHOD AND PRINTED MATTER

CROSS-REFERENCE TO RELATED APPLICATIONS

This application claims priority to Japanese Patent Application No. 2012-020760 filed on Feb. 2, 2012. The entire disclosure of Japanese Patent Application No. 2012-020760 is hereby incorporated herein by reference.

BACKGROUND

1. Technical Field

The present invention relates to a printing apparatus, a printing method and a printed matter.

2. Related Art

An ink jet type printer is in wide use, which forms an image by ejecting an ink. With regard to the ink jet type printer like this, a printing style is considered which forms the image, which is observed from the medium side, by ejecting a color ink and a glitter ink onto a transparent medium.

JP-A-2004-122505 discloses that a printed matter is provided in such a manner that at least one color of a print portion printed in multiple colors is determined as a latent image and the latent image print portion has a greater amount of specular reflection than other print portion. JP-A-8-150800 discloses that a flat portion creating the specular reflection light in a concave and convex pattern is formed, and in a case where the flat portion is color-copied, the flat portion appears in black. Furthermore, JP-A-10-000850 discloses that a color is printed on a metallic base, but the color does not cover the whole metallic substance.

JP-A-2004-122496 discloses that glossiness is changed by controlling the degree to which droplets are integrated into one piece. JP-A-2011-183677 discloses that a special glossy ink and a dye color ink are discharged. JP-A-2010-52244 discloses that an image layer and a special glossy layer are superimposed on a print medium.

A copying machine performs the copying by detecting a color resulting from a diffuse reflection light. The case is considered where an image that is observed from the transparent medium side is formed in the opposite side of the observing side and the copying is performed from the transparent medium side. The formation of a color image having a glittering background is different from the formation of the color image not having the glittering background in terms of rates of diffuse reflection light and specular reflection light. When the rate of the diffuse reflection light is decreased and the rate of the specular reflection light is increased, the color of the printed matter is difficult to detect from the diffuse reflection light, and the resulting copy of the color image may not be appropriately obtained. On the other hand, when the rate of the specular reflection light is decreased and the rate of the diffuse reflection light is increased, a disadvantage occurs in that the copying is made possible in a case where the copying is not caused to be performed. Consequently, in a case of forming the image having the glittering background in the transparent medium, it is preferable that the degree to which the copying is able to be performed is controllable.

SUMMARY

An advantage of some aspects of the invention is to control the degree to which the copying is able to be performed.

According to an aspect of the invention, there is provided a printing apparatus including a first nozzle through which to eject a clear ink, a second nozzle through which to eject a color ink, a third nozzle through which to eject a glitter ink, a control unit that controls ejections of the inks through the first nozzle, the second nozzle and the third nozzle, wherein the control unit performs control, at the time of forming a color image on a transparent medium, in a manner that ejects the clear ink onto the transparent medium through the first nozzle, ejects the color ink onto the clear ink through the second nozzle to form an image resulting from the color ink, and ejects the glitter ink onto the clear ink and the color ink through the third nozzle.

Other features of the invention are made definite by descriptions of the present specification and the drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
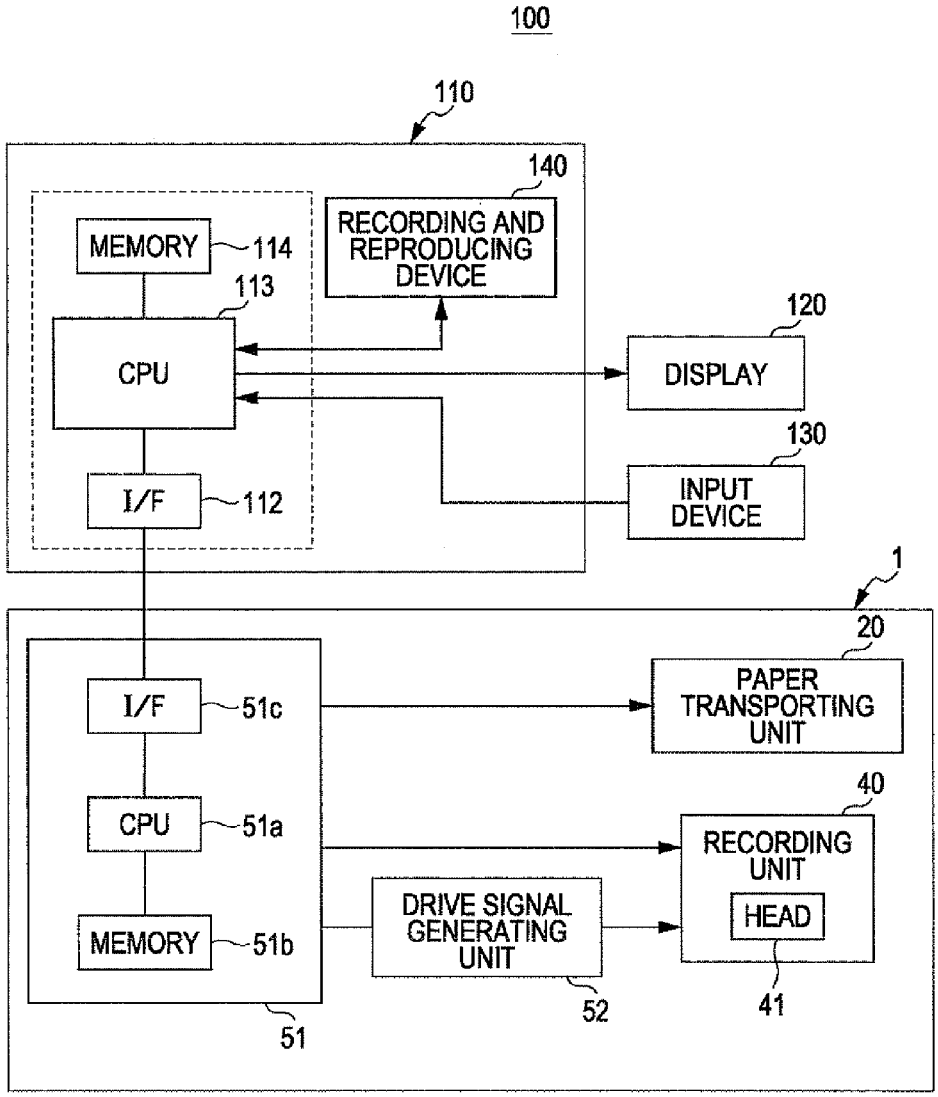
FIG. 1 is a block diagram illustrating a printing system according to a first embodiment.

The following matters are at least made definite by the descriptions of the present specification and the accompanying drawings. That is, in a printing apparatus including a first nozzle through which to eject a clear ink, a second nozzle through which to eject a color ink, a third nozzle through which to eject a glitter ink, a control unit controlling ejections of the inks through the first nozzle, the second nozzle and the third nozzle, in which the control unit performs control, at the time of forming a color image on a transparent medium, in a manner that ejects the clear ink onto the transparent medium through the first nozzle, ejects the color ink onto the clear ink through the second nozzle to form an image resulting from the color ink, and ejects the glitter ink onto the clear ink and the color ink through the third nozzle.

By doing this, the reflection condition of the light that is incident on the transparent medium may be adjusted by the clear ink landed on the transparent medium. Specifically, an amount of specular reflection and an amount of the diffuse reflection may be adjusted by the clear ink. Accordingly, the ease and the difficulty with which the copying is performed may be adjusted. And the degree to which the copying can be performed may be controlled.

In the printing apparatus, it is preferable that the control unit is able to control an amount of the clear ink that is to be ejected onto the transparent medium through the first nozzle.

By doing this, in a case where the amount of the clear ink is decreased, the clear inks may be arranged at intervals on the transparent medium, and in a case where the amount of the clear ink is increased, the clear inks may be arranged on the transparent medium, in a manner that are integrated into one piece.

Furthermore, it is preferable that the control unit performs the control in a manner that ejects the clear ink through the first nozzle so that the clear ink and other clear ink landed on the transparent medium are integrated into one piece.

By doing this, the clear inks are integrated into one piece on the medium and thus leveling is performed in a manner that fills a concavity and convexity on the medium. And the performance of the copying may be made difficult by increasing a rate of the specular reflection light.

Furthermore, the control unit may perform the control in a manner that ejects the clear ink through the first nozzle so that the clear ink and other clear ink landed on the transparent medium are not integrated into one piece.

By doing this, since the clear inks are at intervals on the medium in such a manner that the clear inks are integrated into one piece, the clear inks are fixed in the dot shape. In a case where the clear ink is fixed in the dot shape, the incident light is diffused and the copying may be easy to perform.

Furthermore, the clear ink is an ink that is to be hardened by the emitted light. Additionally, the control unit, equipped with an emitting device that emits the light, may perform the control in a manner that hardens the clear ink by emitting the lights from the emitting device after the clear inks landed on the transparent medium are integrated into one piece and ejects the color ink through the second nozzle after the hardening.

By doing this, the clear inks may be hardened after being integrated into one piece and the color ink may be ejected onto the clear ink. In this case, the leveling is performed in a manner that integrates the clear inks into one piece and fills the concavity and convexity on the transparent medium, and thereafter the color ink is ejected. The leveled clear ink creates the specular reflection of the incident light. Consequently, the performance of the copying may be made difficult by increasing the specular reflection light.

Furthermore, the clear ink is the ink that is to be hardened by the emitted light. Additionally, the control unit, equipped with the emitting device that emits the light, may perform the control in a manner that hardens the clear ink by emitting the lights from the emitting device before the clear inks landed on the transparent medium are integrated into one piece and ejects the color ink through the second nozzle after the hardening.

By doing this, the color ink may be ejected after the clear inks are hardened before being integrated into one piece. In this case, since the clear ink is hardened in the shape that the clear ink takes at the time of landing, the diffuse reflection of the incident light is easy to create. Consequently, the performance of the copying may be made easy by increasing the diffuse reflection light.

Furthermore, the following matters are at least made definite by the descriptions of the present specification and the accompanying drawings. That is, a printing method of forming a color image on a transparent medium, includes ejecting a clear ink on the transparent medium, forming an image by ejecting a color ink onto the clear ink, and ejecting a glitter ink onto the clear ink and the color ink.

By doing this, the reflection condition of the light that is incident on the transparent medium may be adjusted by the clear ink landed on the transparent medium. Specifically, the amount of the specular reflection and the amount of the diffuse reflection may be adjusted by the clear ink. Accordingly, the ease with which the copying is performed and the difficulty with which the copying is performed may be adjusted. And the degree to which the copying is able to be performed may be controlled.

Furthermore, the following matters are at least made definite by the descriptions of the present specification and the accompanying drawings. That is, there is a printed matter, in which a clear ink is ejected on a transparent medium, an image is formed from a color ink being ejected on the clear ink, and a glitter ink is ejected on the clear ink and the clear ink.

By doing this, the reflection condition of the light that is incident on the transparent medium may be adjusted by the clear ink landed on the transparent medium. Specifically, the amount of the specular reflection and the amount of the diffuse reflection may be adjusted by the clear ink. Accordingly, the ease with which the copying is performed and the difficulty with which the copying is performed may be made to be adjusted. And the degree to which the copying is able to be performed may be controlled.

Embodiment

FIG. 1 is a block diagram illustrating a printing system 100 according to a first embodiment. A general configuration of the printing system 100 according to the first embodiment is described below referring to this.

The printing system 100 has an ink jet printer 1 (hereinafter referred to as a "printer 1" for short) as the printing apparatus and a computer 110, a display 120, and an input device 130. The printer 1 prints the image on the medium such as a sheet of paper, a piece of cloth, and a film. The computer 110 is connected to the printer 1 via an interface 112 in a communication-enabled manner. And in order to cause the printer 1 to print the image, the computer 110 outputs print data corresponding to that image to the printer 1. The computer 110 includes a CPU 113, a memory 114, the interface 112, and a recording and reproducing device 140. And computer programs, such as an application program and a printer driver, are installed. The recording and reproducing device 140, for example, is a flexible disk drive device or a CD-ROM drive device.

The display 120, for example, is a liquid crystal monitor. The display 120, for example, is one for displaying the user interface of a computer program. The input device 130, for example, is a keyboard or a mouse.

The ink jet printer 1 includes a paper transporting unit 20, a recording unit 40, a control unit 51, and a drive signal generating unit 52. The paper transporting unit 20 supplies the medium from a roller paper R to the recording unit 40 and discharges the medium after the printing. The recording unit 40, as described below, moves a carriage 43, which is equipped with a head 41, and performs an image formation on the medium by ejecting the ink from the head 41.

Furthermore, the ink jet printer 1 includes a control unit 51 that controls the operation of each of the constituent elements, in an integrating manner. The control unit 51 includes a CPU 51*a* that performs, for example, a calculation, a memory 51*b* that stores, for example, a program and a calculation result, and an interface 51*c* that performs a communication with an external apparatus. The control unit 51 controls the paper transporting unit 20, the recording unit 40, and a drive signal generating circuit 52.

The drive signal generating unit 52 supplies a drive signal COM to each piezoelectric element PZT (to be described below) of the head 41 of the recording unit 40. Digital data, which specify the shape of the drive signal, is sent from the control unit 51 to the drive signal generating unit 52, and the drive signal generating unit 52 generates the drive signal COM that is a voltage waveform, based on the digital data.

Figure 2:
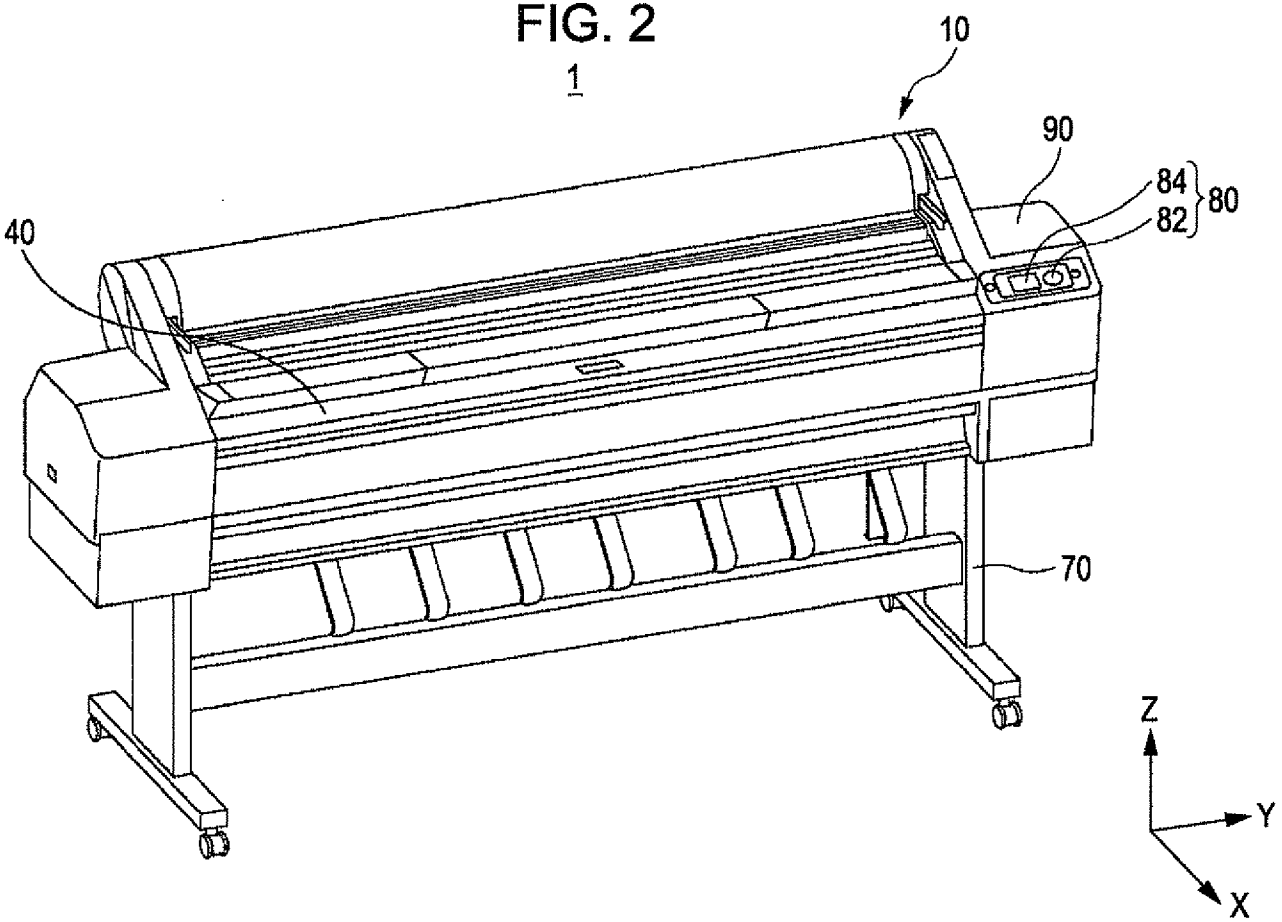
FIG. 2 is a perspective view illustrating an ink jet printer according to the first embodiment.
Figure 3:
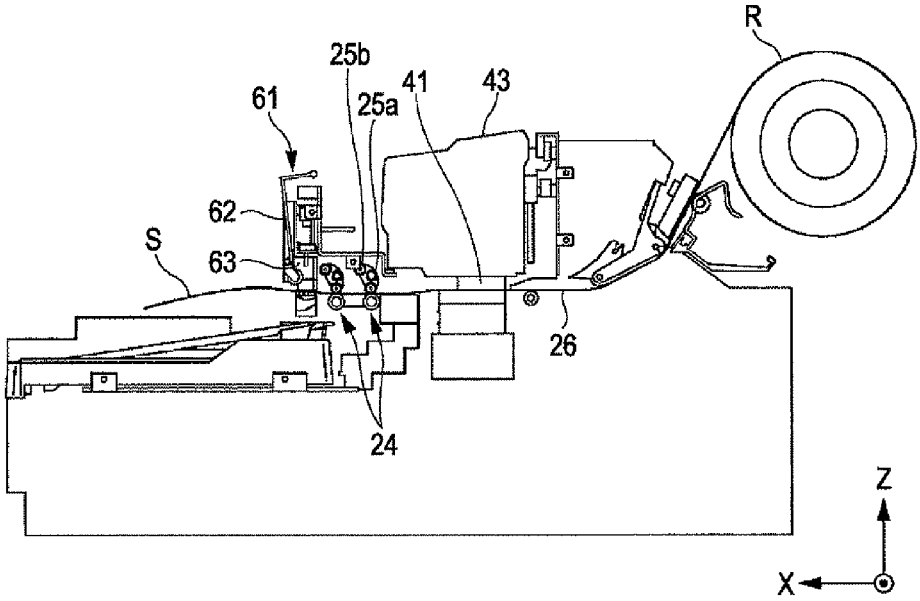
FIG. 3 is a side view illustrating the inside of the ink jet printer according to the first embodiment.

FIG. 2 is a perspective view illustrating the ink jet printer 1 according to the first embodiment. FIG. 3 is a side view illustrating the inside of the ink jet printer 1 according to the first embodiment. In the following description, the transporting direction (the discharging direction) of the medium is referred to as the X-axis direction, the width direction (the direction perpendicular to the page space in FIG. 3) of a transportation path 26 intersecting the X axis direction as the Y axis direction and the vertical direction intersecting the X axis direction and Y axis direction as the Z axis direction.

As illustrated in FIG. 2, the ink jet printer 1 includes the recording unit 40 that is arranged in such a manner that the longitudinal direction is the horizontal direction, a housing 90 that is mounted on an end portion of the recording unit 40, a load portion 10 mounted above the recording unit 40, and a leg portion 70 supporting the recording unit 40 and the housing 90 from below.

The recording unit 40 includes the head 41 that ejects the ink with respect to the medium that arrives by transportation along the transportation path 26. The head 41 is mounted on the carriage 43 that is freely movable in the width direction of the transportation path 26. An ink cartridge (not illustrated), which stores the ink, is mounted on the printer 1. The ink of each color is supplied from the ink cartridge to the head 41. The head 41 includes multiple rows of nozzles and is configured in such a manner that the ink of a predetermined color (for example, yellow (Y), magenta (M), cyan (C), black (K), clear (Cl), metallic (Me)) is able to be ejected through each row of nozzles. The head 41 performs the image formation that records, for example, predetermined image information and predetermined letter information by ejecting the ink with respect to the record surface of the medium.

The medium, on which the image formation is performed by the recording unit 40, is discharged from a discharge roller 24. The discharge roller 24 includes a mechanism by which a roller performing the nipping depending on the kind of paper is changed to an incision roller 25*a* or a roller 25*b*.

A cutting device 61, which cuts the discharged medium to the predetermined size, is provided in the downstream side of the discharge roller 24. The cutting device 61 has a regulating member 62 that regulates a height position of the discharged medium, and a cutting unit 63 that cuts the medium by moving in the width direction (the Y axis direction) intersecting the discharging direction (the X axis direction) of the medium.

A manipulation panel 80 is arranged on the housing 90. The manipulation panel 80 includes multiple switches 82 that a user operates and a displaying unit 84 displaying the operation status of the printer 1. Accordingly, when the direction in which the manipulation panel 80 and the cartridge holder are arranged is defined as the front side, the user operates the printer 1 from this front side.

Figure 4:
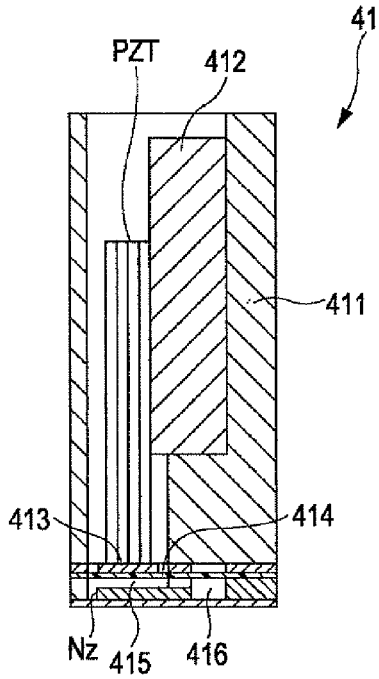
FIG. 4 is a cross-sectional view illustrating the construction of a head.

FIG. 4 is a cross-sectional view illustrating a construction of the head 41. A flow channel 416 is formed in the head 41 and the ink is supplied through the flow channel 416. An adhesion substrate 412 is fixed to a case 411 of the head 41. The adhesion substrate 412 is in the rectangular-shaped plate, and further the piezoelectric element PZT adheres to one surface. An island portion 413 is connected to the tip of the piezoelectric element PZT, an elastic region is formed from an elastic film 414, in the vicinity of the island portion 413.

The piezoelectric element PZT is transformed by a potential difference between the opposing electrodes. In this example, the piezoelectric element PZT expands and contracts in the longitudinal direction. An amount of the elasticity is determined according to the potential of the piezoelectric element PZT. And when the piezoelectric element PZT expands and contracts, the island portion 413 is pushed to the side of a pressure chamber 415 and is pulled in the opposite direction. At this time, since the elastic film 414 in the vicinity of the island portion is transformed, the ink may be efficiently ejected through the nozzle Nz.

With a configuration like this, the inks of multiple sizes may be ejected by adjusting the amplitude of the drive signal that is to be applied to the piezoelectric element PZT. Accordingly, an amount of the ink to be ejected (the ejection duty) may be appropriately controlled.

Figure 5:
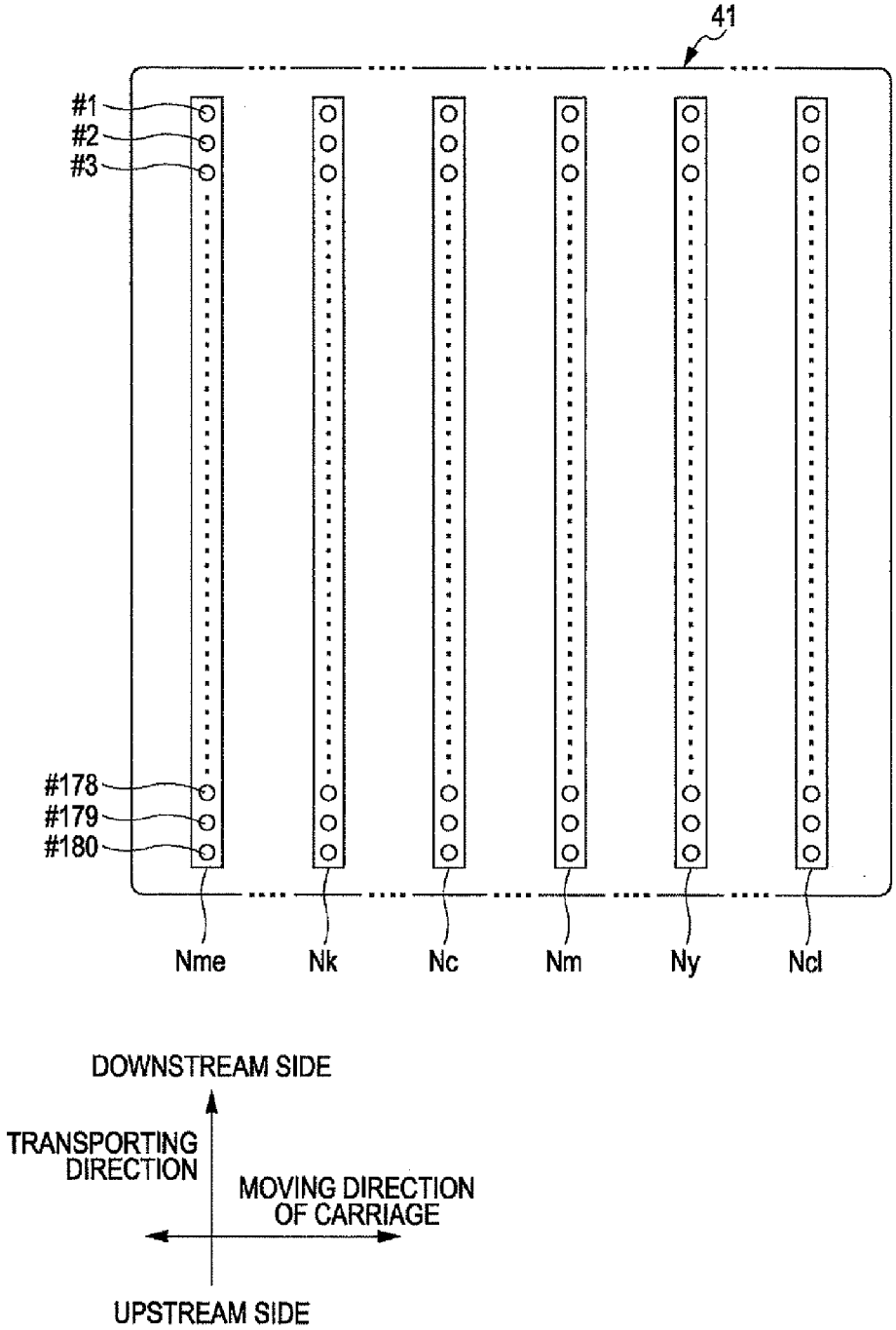
FIG. 5 is a view illustrating a nozzle of the head.

FIG. 5 is a view illustrating the nozzle of the head 41. From the head 41 according to the first embodiment, six kinds of inks, which are yellow ink Y, magenta ink M, cyan ink C, black ink K, metallic ink Me, and clear ink C1, may be ejected. The clear ink C1 is a transparent or translucent ink. Additionally, the yellow ink Y, the magenta ink M, the cyan ink C, and the black ink K are referred to as the color ink Co.

The metallic ink Me is hereinafter described. The metallic ink Me contains a metallic pigment and an organic solvent. As long as the metallic pigment has a function such as metallic luster, the metallic pigment is not given any especial limitation, but aluminum, or aluminum alloy, or silver, or silver alloy is desirable. The metallic ink is contained in the glitter ink. At this point, the glitter ink has a surface characteristic that creates the specular reflection of the light. Additionally, the pigment contained in the glitter ink is not limited to the metallic pigments as described above, but whatever glitter ink shows the surface characteristic such as the metallic luster is permitted.

Examples of the six nozzle rows are illustrated in the drawings. While the head 41 is moved in the moving direction of the carriage, the clear ink is ejected through the nozzles in the clear ink nozzle row Ncl. Furthermore, the black ink is ejected through the nozzles in the black ink nozzle row Nk. Furthermore, the cyan ink is ejected through the nozzles in the cyan ink nozzle row Nc. Furthermore, the magenta ink is ejected through the nozzles in the magenta ink nozzle row Nm. Furthermore, the yellow ink is ejected through the nozzles in the yellow ink nozzle row Ny. Furthermore, the metallic ink is ejected through the nozzles in the metallic ink nozzle row Nme.

The ejection of the clear ink C1 through the clear ink nozzle row Ncl, the ejection of the color ink Co through the color ink nozzle row and the ejection of the metallic ink through the metallic ink nozzle row Nme are controlled by the control unit 51 described above.

With the configuration like this, the clear ink C1 may be ejected onto the medium and the color ink Co may be ejected onto the clear ink C1. Furthermore, the metallic ink Me may be ejected onto the color ink Co.

Figure 6:
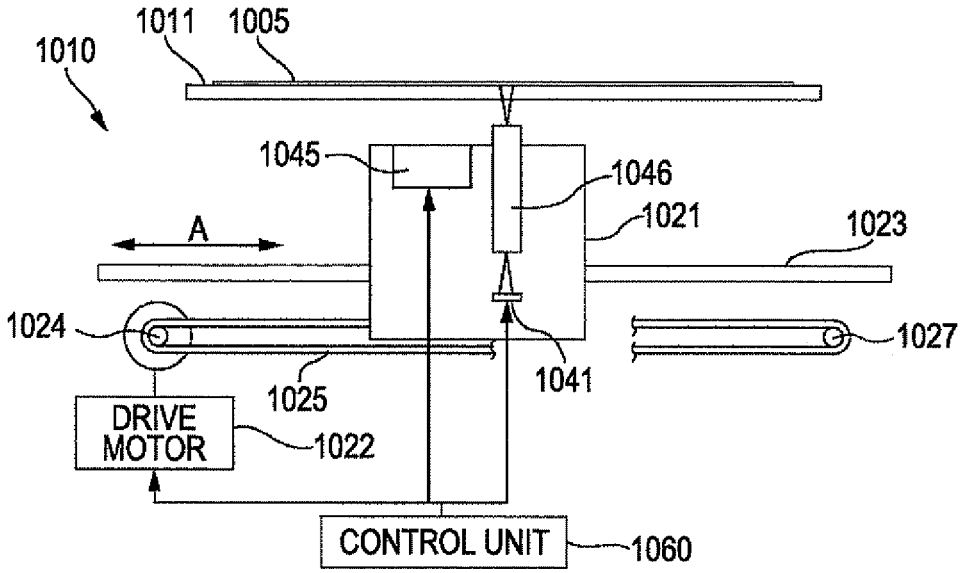
FIG. 6 is a view illustrating a reading mechanism in a copy apparatus.

FIG. 6 is a view illustrating a reading mechanism in a copy apparatus. A scanner 1010 includes a carriage 1021 and a carriage moving mechanism that moves a carriage 1021 in parallel along the A direction indicated by an arrow in the drawing (the secondary scanning direction) below a manuscript supporter 1011 while maintaining a predetermined interval with respect to the manuscript supporter 1011.

The carriage moving mechanism includes a guide 1023 that guides the movement of the carriage 1021 while supporting the carriage 1021. Furthermore, the carriage moving mechanism includes a belt 1025 connected to the carriage 1021, a shaft 1024 and a pulley 1027 on which the belt 1025 is placed and a drive motor 1022 to rotatably drive the shaft 1024. The drive motor 1022 is drive-controlled by a control signal from the control unit 1060.

Each unit of the reading mechanism is included in the carriage 1021, and an exposure lamp 1045, as a light source, which emits light with respect to a manuscript 1005 via the manuscript supporter 1011, a lens 1046 on which the diffuse reflection light reflected by the manuscript 1005 is incident, and an image sensor 1041 that receives the diffuse reflection light importing into the carriage 1021 via the lens 1046 are provided in the carriage 1021.

The image sensor 1041 is configured by a linear CCD sensor in which photoelectric transducers, such as photo diodes, which converts an optical signal to an electrical information, are arranged in rows. Data on the image read by the image sensor 1041 is output to the control unit 1060. The copy apparatus performs the copying on the medium such as a sheet of paper, based on the diffuse reflection light data input to the control unit.

Figure 7:
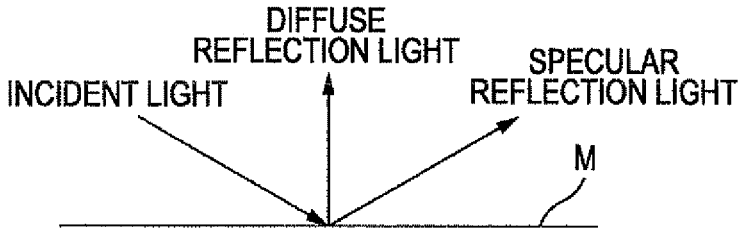
FIG. 7 is a view illustrating a specular reflection light and a diffuse reflection light.

FIG. 7 is a view illustrating the specular reflection light and the diffuse reflection light. The reflection of the incident light incident on the medium M as the specular reflection light (the mirror surface reflection light) and the diffuse reflection light is illustrated in the drawings. As described above, in the reading mechanism, the diffuse reflection light, which is reflected by the incident light from the exposure lamp 1045 being diffused in the medium, is read by the image sensor 1041. Consequently, when the rate of the diffuse reflection light to the reflection light is appropriate, the copying of the medium is performed appropriately. On the other hand, in a case where the rate of the specular reflection light to the reflection light is high and the rate of the diffuse reflection light is low, the copying is not appropriately performed because an amount of the diffuse reflection light is insufficient. Specifically, since an amount of diffuse reflection light is small, the black copying as a whole is created.

Figure 8A:
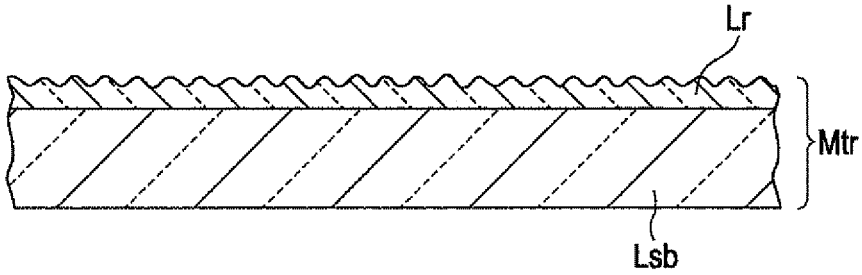
FIGS. 8A and 8B are cross-sectional views illustrating a transparent medium and a cross-sectional view illustrating the performance of the metallic tone printing on the transparent medium, respectively.

FIG. 8A is a cross-sectional view illustrating a transparent medium Mtr. As illustrated in FIG. 8A, transparent medium Mtr, for example, is configured by forming a reception layer Lr, which receives the ink, on a base material Lsb. Consequently, the ink is ejected onto the reception layer Lr. And the image is observed from the side of the base material Lsb. The transparency is secured in the transparent medium Mtr, to such a degree that at least the image is able to be recognized from the side of the base material.

A flat surface is formed in the base material Lsb itself. However, the reception layer Lr, to which the ink adheres, is provided on the transparent medium Mtr. The reception layer Lr, for example, is categorized into a swelling type reception layer of, for example, urethane, and a porosity type reception layer of, for example, silica gel or alumina. The surface of the porosity type reception layer may be formed comparatively flat, but the surface of the swelling type reception layer has a concavity and convexity.

However, the porosity type reception layer has difficulty in securing transparency, because the porosity type reception layer slightly takes on whiteness. On the other hand, the swelling type reception layer of, for example, urethane, may secure more transparency than the porosity type reception layer. Consequently, the transparent medium having the concavity and convexity like this is adopted, but the concavity and convexity surface like this diffuses the incident light.

Figure 8B:
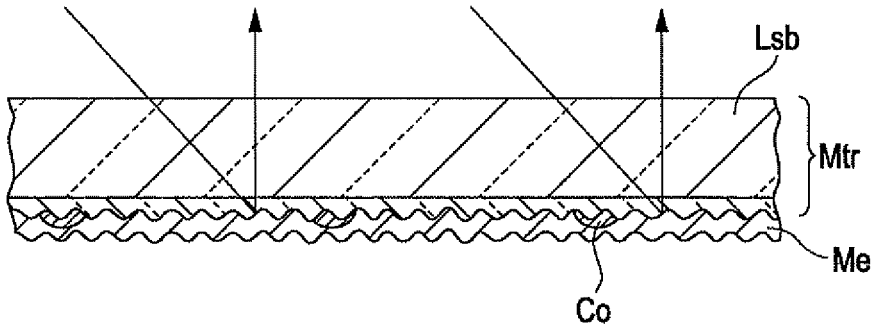

FIG. 8B is a cross-sectional view illustrating the performance of the metallic tone printing on the transparent medium Mtr. The state is illustrated in FIG. 8B, in which a dot is formed on the transparent medium Mtr having a concavity and convexity, with the color ink Co and further a layer (a metallic ink layer) is formed with the metallic ink Me.

In the transparent medium Mtr like this, the incident light penetrates the base material Lsb and the reception layer Lr because the base material Lsb and the reception layer Lr are all transparent. However, the incident light turns into the reflection light in the surface of the reception layer Lr, because refractive indices of the reception layer Lr and the air are different. When the reception layer Lr has the concavity and convexity, the incident light on the concavity and convexity turns into the diffuse reflection light.

When the rate of the diffuse reflection light is high, the copying is comparatively easy to perform, as described above. Consequently, when the control may be performed in a manner that reduces the diffuse reflection light like this, the printed matter of which the copying is difficult to perform may be provided.

Figure 9A:
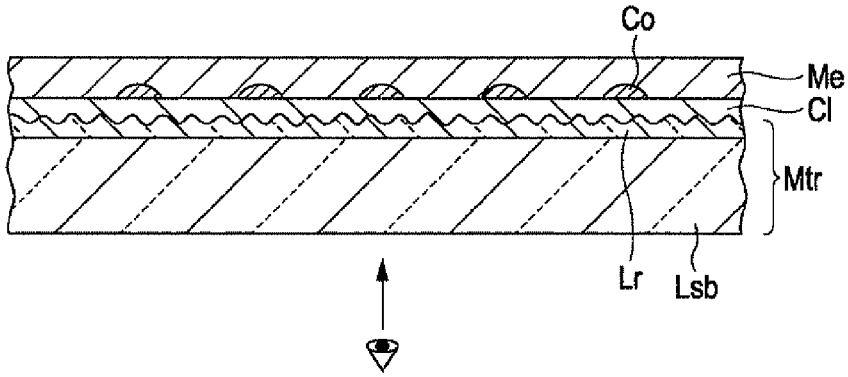
FIGS. 9A and 9B are views illustrating the formation of a dot according to the first embodiment, and a view illustrating an incident light and a reflection of light, respectively, according to the first embodiment.

FIG. 9A is a view illustrating the formation of a dot according to the first embodiment. In FIG. 9A, a human eye is schematically illustrated and the recognition of the image from the rear side of the transparent medium Mtr according to the first embodiment is illustrated.

As described above referring to FIGS. 8A and 8B, the surface of the transparent medium Mtr has a concavity and convexity that diffuses the incident light. Consequently, according to the first embodiment, the flat surface is formed by filling the concavity and convexity with the clear ink C1. And, the rate that the incident light turns into the diffuse reflection is decreased. Additionally, the color image is formed on the flat surface, with the color ink Co. And the metallic ink layer is further formed from the metallic ink Me.

Figure 9B:
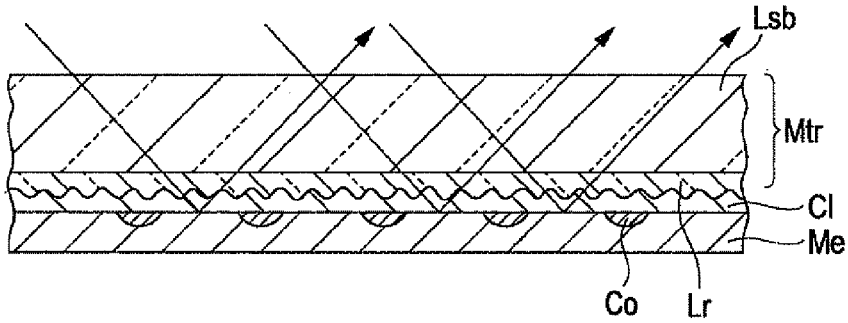

FIG. 9B is a view illustrating the incident light and the reflection light according to the first embodiment. In FIG. 9B, the incident light penetrates the transparent medium Mtr and further penetrates the layer of the clear ink C1 that is the transparent ink. And the incident light does the specular reflection in the layer of metallic ink Me and the specular reflection light also penetrates the layer of the clear ink C1 and the transparent medium Mtr at almost the same angle. That is, the incident light turns into the specular reflection light with high probability.

In this manner, since the concavity and convexity of the transparent medium Mtr is filled with the clear ink C1, and the layer of the metallic ink Me is further formed on the clear ink C1, the rate that the incident light turns into the specular reflection light may be increased. And the printed matter of which the copying is difficult to perform may be provided by increasing the rate of the specular reflection light.

The printing like this, for example, may be performed as follows. First, the clear ink C1 is ejected from the head 41 onto the transparent medium Mtr. An amount of the clear ink C1 is ejected to such a degree that the concavity and convexity surface is able to be flat. Further, until the clear ink C1 landed on the transparent medium Mtr forms the flat surface, other inks such as the color ink Co are not permitted to be ejected onto the clear ink C1.

After the clear ink C1 forms the flat surface, the color ink Co is ejected from the head 41 and the color image is formed. And the metallic ink Me is ejected from the head 41 after the dot of the landed color ink Co is solidified in such an extent that transformation does not occur. And the metallic ink layer is formed.

Figure 10A:
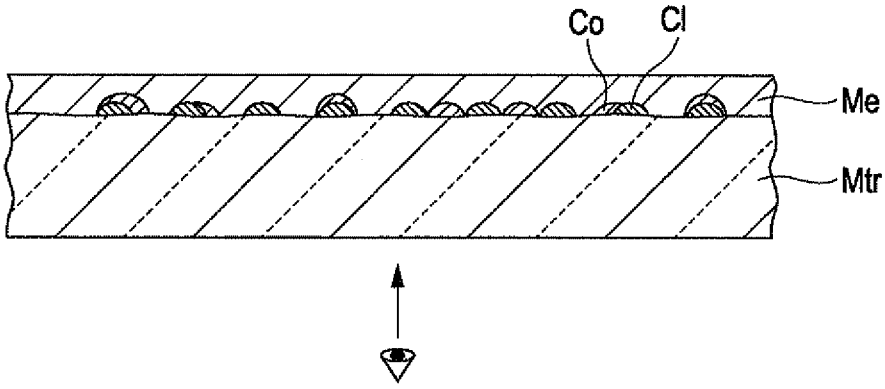
FIGS. 10A and 10B are views illustrating the formation of a dot according to a second embodiment, and a view illustrating an incident light and a reflection of light, respectively, according to the second embodiment.

FIG. 10A is a view illustrating the formation of a dot according to a second embodiment. In FIG. 10A, a human eye is schematically illustrated and the recognition of an image from the rear side of a transparent medium Mtr according to the second embodiment is illustrated.

The case is considered where the image is formed on the transparent medium Mtr having comparatively small concavity and convexity, with the color ink Co and the metallic ink Me. In a case where the surface of the transparent medium Mtr is flat, most of the incident light turns into the specular reflection light in the layer of the metallic ink Me. Consequently, in a case where the printed matter like this is copied, the copying is difficult to perform.

According to the second embodiment, the printing is performed as illustrated in FIG. 10A, in order for the copying to be easily performed with respect to the printed matter like this. That is, the dot is formed on the transparent medium Mtr, with the clear ink C1. What distinguishes the second embodiment from the first embodiment described above is that the amount of the clear ink C1 is not ejected to such an extent that the leveling (flattening) is able to be achieved. After the dot of the clear ink C1 is formed in this manner, the image is formed with the color ink Co. And the metallic ink Me is further ejected and the layer of the metallic ink is formed.

Figure 10B:
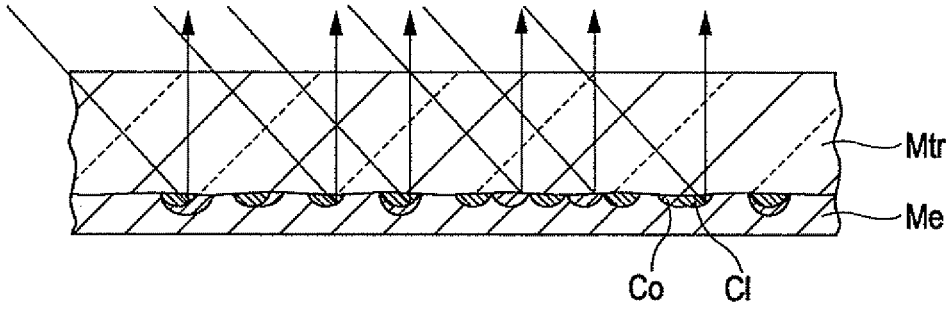

FIG. 10B is a view illustrating the incident light and the reflection light according to the second embodiment. With regard to the printed matter illustrated in FIG. 10A, the turning of the incident light from the side of the transparent medium into the diffuse reflection light is illustrated in FIG. 10B. Specifically, the incident light penetrates the transparent medium Mtr. If the dot of clear ink C1 is not formed, while part of the incident light turns into the diffuse reflection light due to the color ink Co, most of the incident lights turn into the specular reflection light due to the layer of the metallic ink Me. That is, the printed matter turns into one of which the copying is difficult to perform. However, according to the second embodiment, the incident light that was made the specular reflection light due to the layer of the metallic ink Me turns into the diffuse reflection light due to the dot of the clear ink C1. That is, the rate of the specular reflection light is decreased and the rate of the diffuse reflection light is increased.

In this manner, the printed matter of which the copying is easy to perform may be provided by increasing the rate of the diffuse reflection light by ejecting the clear ink C1 to such an extent that the leveling is not made and forming the dot of the clear ink C1.

Other Embodiments

While the clear ink C1 is leveled according to the first embodiment described above the clear ink C1 is hardened in the dot shape according to the second embodiment. In this manner, the shape of the clear ink C1 on the transparent medium Mtr may be realized by adjusting an amount of the clear ink to be ejected. For example, the adjacent dots of the clear ink C1 may be integrated into one piece and be leveled by increasing an amount of ejection of the clear ink C1. On the other hand, the adjacent dots of the clear ink C1 may be hardened without being integrated into one piece, by decreasing an amount of ejection of the clear ink C1.

Furthermore, the shape of the clear ink C1 on the transparent medium Mtr may be controlled also by adjusting the period of time during which the clear ink C1 is left unattended after landed on the transparent medium Mtr. For example, when the clear ink C1 is ejected and left unattended for a comparatively long time, the adjacent dots are integrated into one piece and leveled. On the other hand, when the clear ink C1 is ejected and immediately thereafter the color ink is ejected, the clear inks are not leveled and are hardened in a state of being at intervals.

Furthermore, the clear ink C1 to be used may be an ultraviolet hardening type ink, and additionally an ultraviolet emitting device may be provided. Accordingly, when the ultraviolet is emitted after the clear ink C1 landed on the transparent medium Mtr is integrated into one piece, the clear ink C1 is leveled. On the other hand, when the ultraviolet is emitted before the clear inks C1 landed on the transparent medium Mtr are integrated into one piece, the clear inks C1 are hardened in a state of being at intervals without the clear inks being leveled.

Furthermore, here, the first embodiment and the second embodiment are separately described, but the printer 1 may have functions of both embodiments. That is, the printer 1 may have a printing mode that realizes the first embodiment and a printing mode that realizes the second embodiment.

According to the embodiments described above the printer 1 as the printing apparatus is described, but the invention is not limited to this printing device and may be embodied as a liquid discharging apparatus that ejects or discharges fluids other than the ink (liquid, a liquid-state material in which particles of a functional material are distributed, and a fluid-state material like gel). For example, the same technologies as the embodiments described above may be applied to various apparatuses to which the ink jet technology is applied, such as a color filter manufacturing apparatus, a dyeing apparatus, a micro fabrication apparatus, a semiconductor manufacturing apparatus, a surface treating apparatus, a three-dimensional molding machine, a gas vaporization apparatus, an organic EL manufacturing apparatus (especially a polymer EL manufacturing device), a display manufacturing apparatus, a film forming apparatus, a DNA chip manufacturing apparatus, and the like. Furthermore, the methods and manufacturing methods in association with these are in the range of applications of the same technologies as the embodiments described above.

The purpose of the embodiment described above is to easily understand the invention, and is not to be interpreted to limit the invention. The invention may be modified and improved without deviating from the gist thereof, and it goes without saying that the invention includes the equivalents thereof.

On Head

According to the embodiments described above, the ink is ejected by using the piezoelectric element. However, the method of ejecting the liquid is not limited to this. For example, other methods, such as a method that generates a bubble within the nozzle by heat, may be employed.

What is claimed is:

1. A printing apparatus comprising:

a first nozzle through which to eject a clear ink;

a second nozzle through which to eject a color ink;

a third nozzle through which to eject a glitter ink; and a control unit that controls ejections of the inks through the first nozzle, the second nozzle and the third nozzle, wherein the control unit performs control, at the time of forming a color image on a transparent medium, in a manner that ejects the clear ink onto the transparent medium through the first nozzle, ejects the color ink on the clear ink through the second nozzle to form an image resulting from the color ink, and ejects the glitter ink onto the clear ink and the color ink through the third nozzle.

2. The printing apparatus according to claim 1, wherein the control unit is able to control an amount of the clear ink that is to be ejected onto the transparent medium through the first nozzle.

3. The printing apparatus according to claim 1, wherein the control unit performs control in a manner that ejects the clear ink through the first nozzle so that the clear ink and other clear ink landed on the transparent medium are integrated into one piece.

4. The printing apparatus according to claim 1, wherein the control unit performs the control in a manner that ejects the clear ink through the first nozzle so that the clear ink and other clear ink landed on the transparent medium are not integrated into one piece.

5. The printing apparatus according to claim 1, wherein the clear ink is an ink that is hardened by a light emitted, and wherein the control unit, equipped with an emitting device that emits the light, performs control in a manner that hardens the clear ink by emitting the light from the emitting device after the clear inks landed on the transparent medium are integrated into one piece and ejects the color ink through the second nozzle after the hardening.

6. The printing apparatus according to claim 1, wherein the clear ink is an ink that is hardened by a light emitted, and wherein the control unit, equipped with an emitting device that emits the light, performs control in a manner that hardens the clear ink by emitting the light from the emitting device before the clear inks landed on the transparent medium are integrated into one piece and ejects the color ink through the second nozzle after the hardening.

7. A printing method of forming a color image on a transparent medium, comprising:

ejecting a clear ink on the transparent medium;

forming an image by ejecting a color ink onto the clear ink; and ejecting a glitter ink onto the clear ink and the color ink.

8. A printed matter that is provided by the printing method according to claim 7.

* * * * *